US010267609B1

(12) United States Patent
Richardson et al.

(10) Patent No.: US 10,267,609 B1
(45) Date of Patent: Apr. 23, 2019

(54) CARTRIDGE RELOADING MACHINE AND COMPONENTS

(71) Applicant: Mark Richardson, Anchorage, AK (US)

(72) Inventors: Mark Richardson, Achorage, AK (US); Ralph Richardson, Palmer, AK (US)

( * ) Notice: Subject to any disclaimer, the term of this patent is extended or adjusted under 35 U.S.C. 154(b) by 0 days.

(21) Appl. No.: 15/894,914

(22) Filed: Feb. 12, 2018

Related U.S. Application Data

(60) Provisional application No. 62/600,016, filed on Feb. 10, 2017.

(51) Int. Cl.
*F42B 33/00* (2006.01)

(52) U.S. Cl.
CPC ..... *F42B 33/004* (2013.01); *F42B 33/001* (2013.01)

(58) Field of Classification Search
CPC ..... F42B 33/00; F42B 33/001; F42B 33/004
See application file for complete search history.

(56) References Cited

U.S. PATENT DOCUMENTS 2,004,420 A * 6/1935 Siebert ..... B23P 19/06 86/23
4,031,804 A * 6/1977 Boschi ..... F42B 33/004 86/23
4,343,222 A * 8/1982 Dillon ..... F42B 33/004 86/23
5,202,529 A * 4/1993 Shields ..... F42B 33/004 86/23

* cited by examiner

*Primary Examiner* — Stephen Johnson
(74) *Attorney, Agent, or Firm* — Rylander & Associates PC; Philip R. M. Hunt

(57) ABSTRACT

This disclosure an improved progressive shell reloader machine with improved components to reduce friction and jarring, thereby reducing powder losses during the reloading process, components including a smooth ring indexer, a gripping shellplate, and an antifriction camming pin. Additional improved components allow easy halting of primer and shell casing feed, facilitating troubleshooting, components including a positionable and reversible case insert slide block and a slide back primer cam.

6 Claims, 22 Drawing Sheets

CARTRIDGE RELOADING MACHINE AND COMPONENTS

CROSS-REFERENCE TO RELATED APPLICATIONS

This application claims the benefit of U.S. Provisional Application No. 62/600,016, filed 2017 Feb. 10, incorporated herein by reference.

TECHNICAL FIELD

This application relates to cartridge reloading machines. In particular, this application relates to progressive reloading machines.

BACKGROUND

Cartridge shell reloading machines have been around for many years. FIG. 1 and FIG. 2 show a typical prior art progressive shell reloader machine 1. The progressive shell reloader machine 1 comprises a main machine assembly 2, a platform assembly 3, a toolhead assembly 4, reloading tools 5, a casefeed assembly 6, a primer feed assembly 7, and a powder check assembly 8. The progressive shell reloader machine 1, sequentially performs the following operations: A shell casing is resized, and the expended primer is removed from the shell casing. A new primer is emplaced in the shell casing and the mouth of the shell casing is expanded to facilitate the insertion of the bullet. Powder is placed in the shell casing. A bullet is inserted in the shell casing. Finally, the bullet is crimped into the shell casing. These operations are performed on a series of shell casings held by the machine and rotated to each of several stations by a cam actuated rotation mechanism. Each pull of the operating handle 9 performs at each station a particular action(s) on the shell casing at that station and then rotates f the shell casings to the next station. Once the first shell has passed through each station, a completed cartridge is delivered with each operation of the operating handle 9.

FIG. 3 shows a view of the main machine assembly 2 of the prior art progressive shell reloader machine 1. The main machine assembly 2 has a frame 26, to which is coupled the casefeed assembly 6. The main machine assembly 2 also has a main shaft 28, which sliding fits through a hold in the frame 26. The main shaft 28 is moved up and down through the frame 26 by the operating handle 9 and a series of linkages. The main machine assembly 2 includes a indexer block 24 and a primer cam 61, both fixed to the frame. The indexer block 24 interacts with the platform assembly 3 to advance the shell casings 56 though the reloading process. The primer cam 61 interacts with the primer feed assembly 7 to advance feeding of primers to the reloading process.

FIG. 4 shows a view of a platform assembly 3 of a prior art progressive shell reloader machine 1. The platform assembly 3 comprises a shellplate 25, a platform 18, a ring indexer 10. The ring indexer 10 is mounted on the main shaft 28. The shellplate 25 nests within the platform 18, which together are coupled to the main shaft 28 over the ring indexer 10 with a shellplate bolt 50.

In operation, the main shaft 28, along with the platform assembly 3, moves upward in response to linkage as the operating handle 9 is rotated downward. In response to the upward rotational motion of the operating handle 9 of the machine, the main shaft 28, along with the platform assembly 3, moves downward. The indexer block 24 mounted on the frame 26 engages a linear cam surface 72 of the ring indexer 10 (See FIG. 5) to cause the ring indexer 10 to rotate the shellplate 25 a number of degrees equal to 360 divided by the number of stations provided by the particular reloading machine. The indexer block 24 has a sloping surface 76 which contacts the cam advance surface 74, forcing the ring indexer 10 to advance to the next station as the operating handle 9 of the reloading machine is moved toward its upper limit. The ring indexer 10 advances the shellplate 25 by means of index pawl 16 and pawl spring 14, with the index pawl 16 engaging with one of a plurality of holes in the shellplate 25. The degree of cam advance is determined by the length of the ring indexer cam surface 72. At the end of the advance of the ring indexer 10, a vertical surface 78 of the indexer block 24 contacts the ring indexer 10 to maintain the ring indexer 10 in its position until a steel indexing ball 22 is snapped into position by an indexing spring 20 to maintain the advancement of the ring indexer 10. When the operating handle 9 of the reloading machine is moved downward again, the platform 18 and the ring indexer 10 are raised clear of the indexer block 24 and an indexer return spring 12 rotates the ring indexer 10 back to its starting position.

Reloading machines typically use sliding contacting elements, which do not control the acceleration and deceleration of moving parts. The result is machines with limited usefulness which spill gunpowder during operation. This slows the process down as the operator must stop and clean up the spilled powder, which is a fire hazard if left. The shell casings from which powder spilled will not have the correct amount of powder, so the operator must remove them and start over.

A first deficiency with this prior art progressive shell reloader machine 1 design is that the steel indexing ball 22, as it is accelerated by the indexing spring 20, causes powder grains to bounce out of the powder charged shell casings as the indexing ball 22 is seated in the shellplate 25.

A second deficiency, as shown in FIG. 5, is the sliding contact between the prior art ring indexer 10 and indexer block 24, which can be rough and halting in operation. The cam advancement mechanism is a compound cam with only sliding contact, having an indexer block 24 with two flat sliding surfaces, the index block sloping surface 76 contacts sloping part of the linear cam 72 and provides the total rotational advancement. The index block vertical surface 78 slidingly contacts the trailing edge of the linear cam 72 to maintain the end of advancement. Because of the sharply different angles of the two surfaces on the indexer block 24, the transition of the indexer block 24 from the sloping part of the linear cam 72 to the trailing edge can be abrupt and jarring. One prior art improvement is to replace the indexer block 24 with a roller cam actuator 30 (See FIG. 11). This reduces the jarring motion as the roller cam actuator 30 contact the sloping part of the linear cam 72, but first contact and the transition to the vertical part of the linear cam 72 can still be jarring.

A third deficiency, is that it is difficult to troubleshoot the progressive shell reloader machine 1 because there is not easy way turn off the shell case feed system and the primary feed system.

A fourth deficiency is the shellplate 25 does not offer firm support to the shell casings allowing powder filled shell casings to bounce and rattle, spilling powder during reloading.

A fifth deficiency is the camming pin 34 was constructed with only a tapered nose providing sliding contact with the slide cam 35. This causes excessive friction and vibration of the case feeder. The above noted faults cause hazardous powder spillage during the reloading process necessitating a slower reloading speed and increase operator fatigue.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

Figure 1:
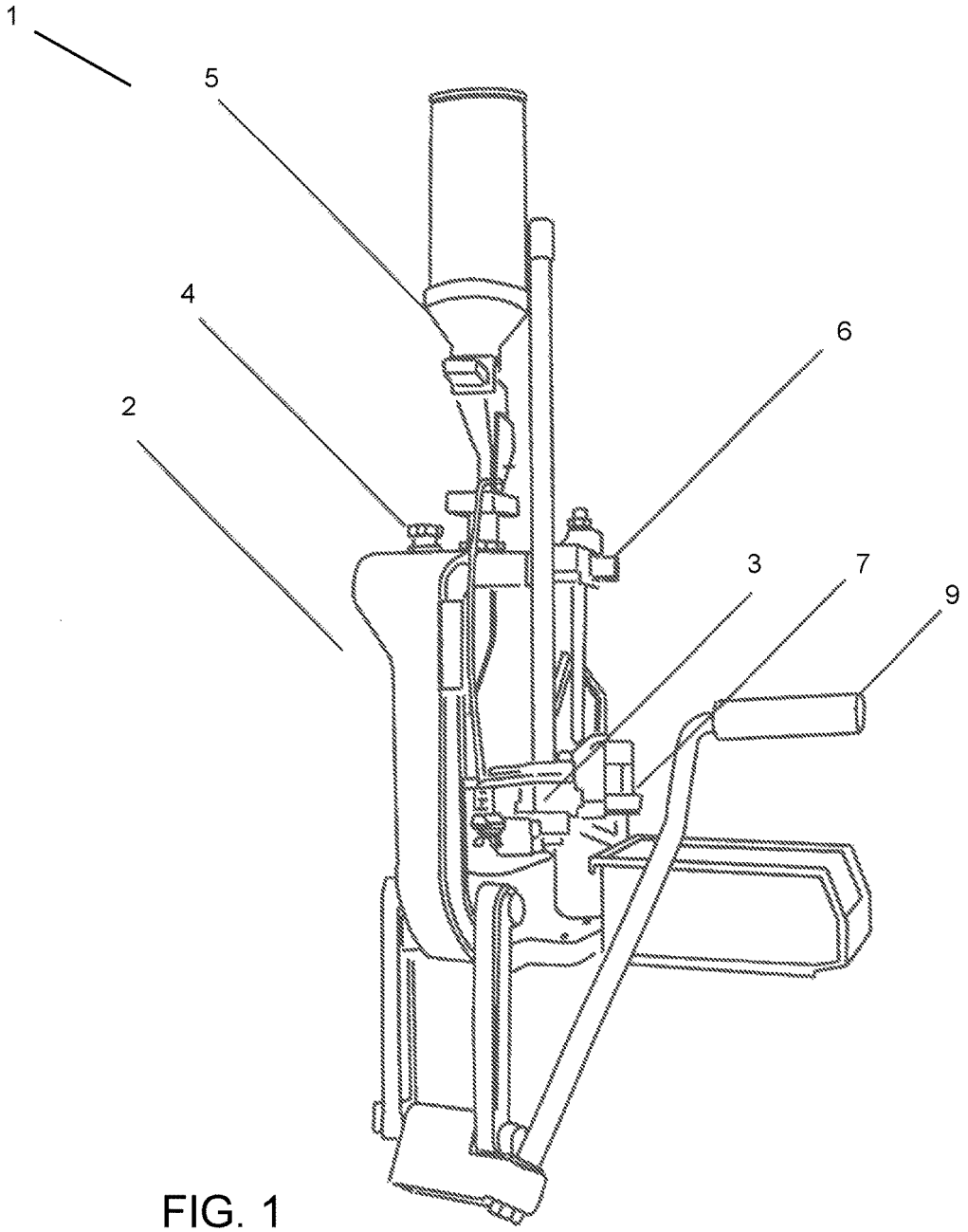
FIG. 1 (Prior Art)
FIG. 1 is a view of a prior art progressive reloading machine.
Figure 2:
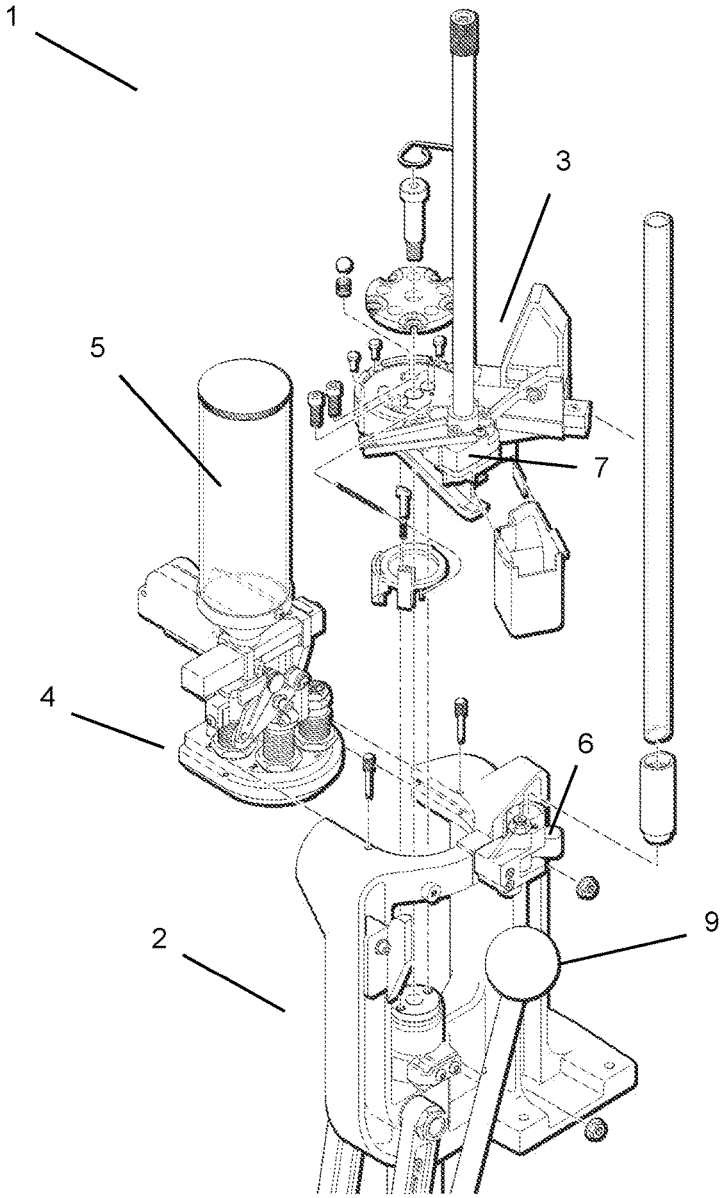
FIG. 2 (Prior Art)
FIG. 2 is a view of a main machine assembly, a platform assembly, and a toolhead assembly of the prior art progressive reloading machine.
Figure 3:
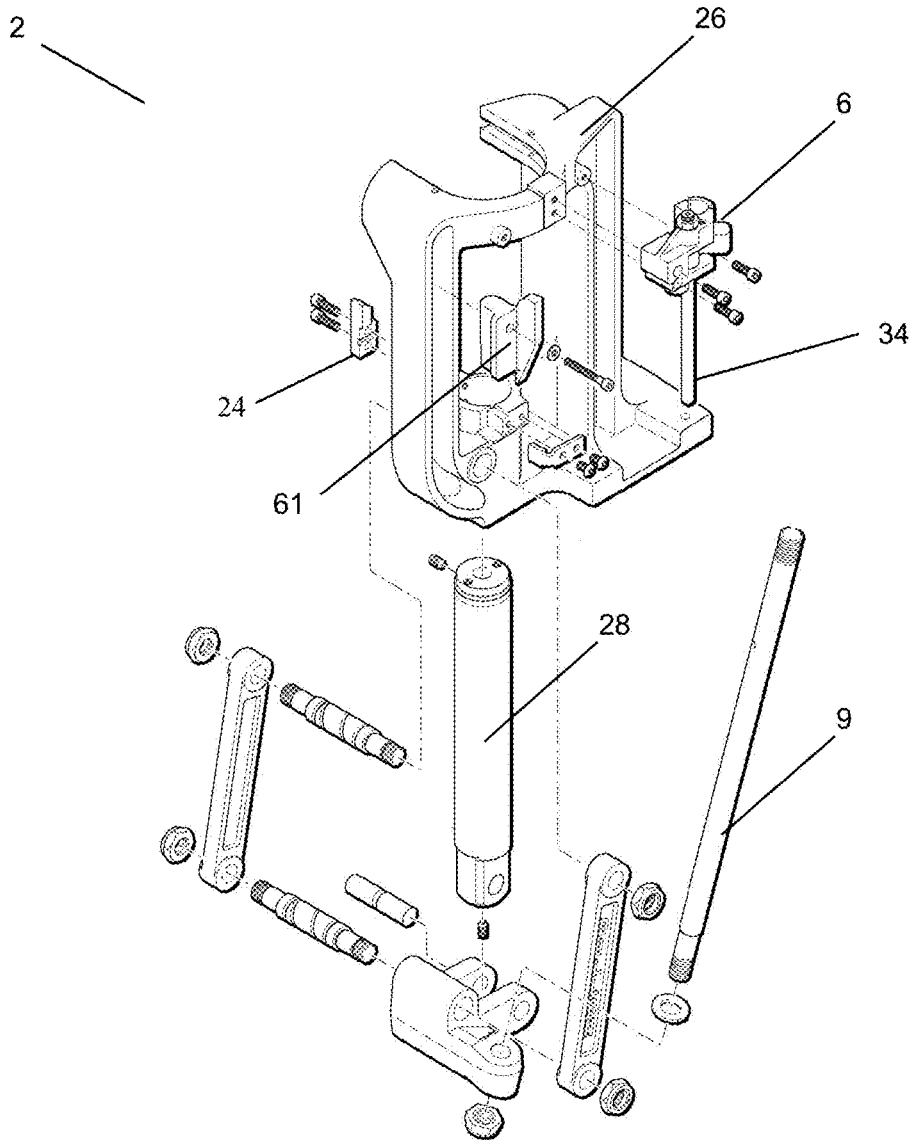
FIG. 3 (Prior Art)
FIG. 3 is a view of the main machine assembly of the prior art progressive reloading machine.
Figure 4:
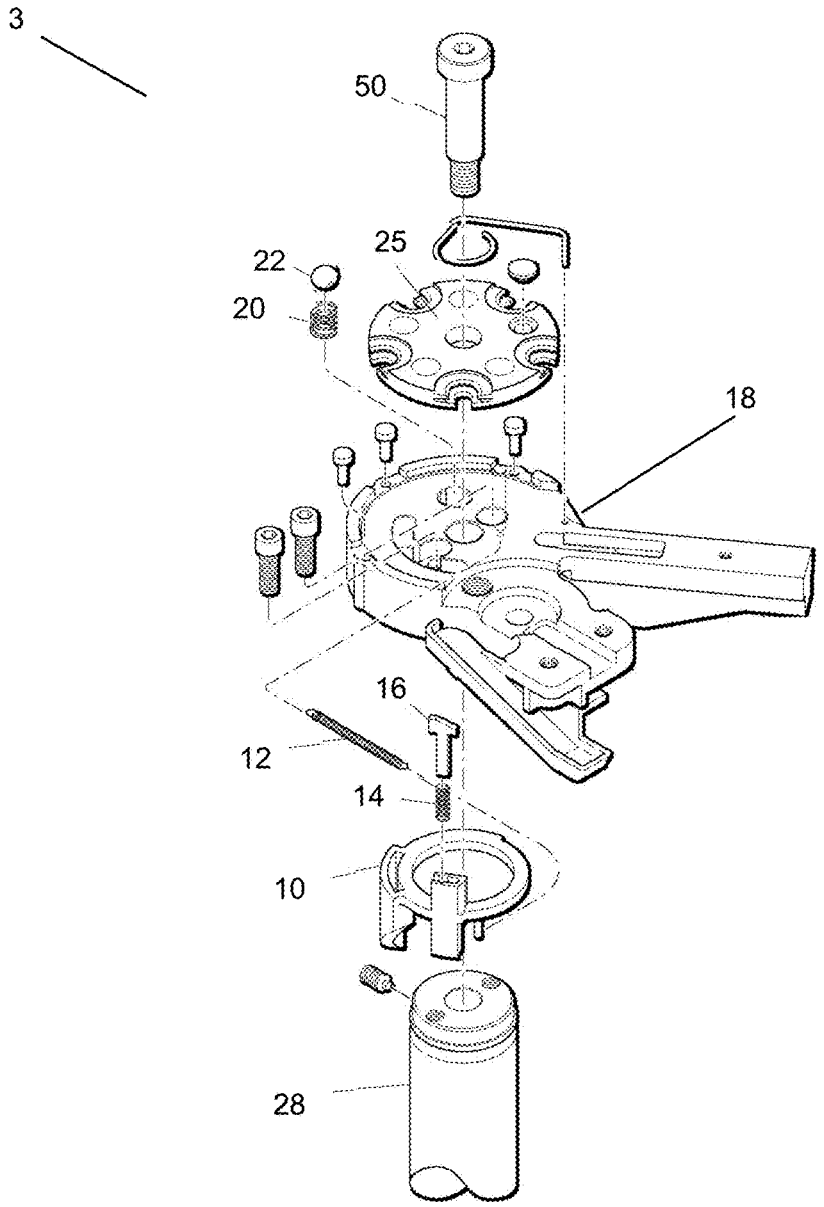
FIG. 4 (Prior Art)
FIG. 4 is a view of a platform assembly of the prior art progressive reloading machine.
Figure 5:
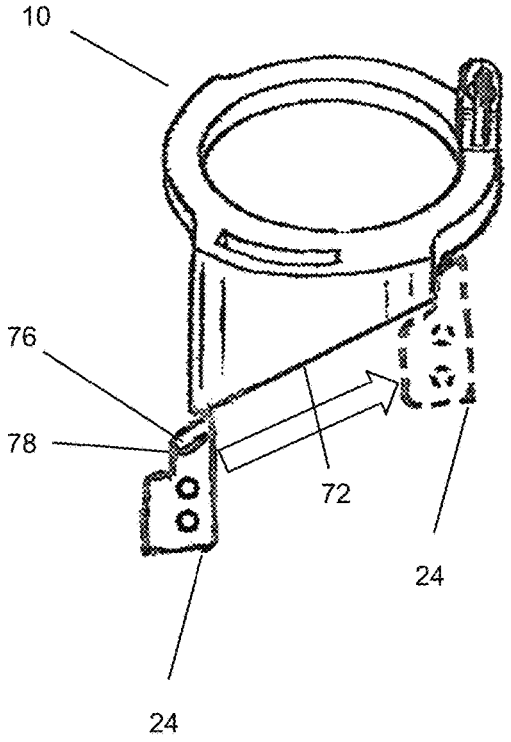
FIG. 5 (Prior Art)
FIG. 5 is a view of a ring indexer of prior art platform assembly of FIG. 4.

REFERENCE NUMBERS progressive shell reloader machine 1
main machine assembly 2
platform assembly 3
toolhead assembly 4
reloading tools 5
casefeed assembly 6
primer feed assembly 7
powder check assembly 8
operating handle 9
ring indexer 10
curved cam ring indexer 11
indexer return spring 12
pawl spring 14
index pawl 16
platform 18
indexing spring 20
indexing ball 22
indexer block 24
shellplate 25
frame 26
main shaft 28
roller cam actuator 30
smooth acceleration cam 32
case insert base 33
camming pin 34
slide cam 35
antifriction camming pin 36
case insert slide spring 37
plastic ball index spring 38
plastic indexing ball 40
upper shellplate 42
lower shellplate 44
elastic element 46
thrust washer 48
shellplate bolt 50
dowel pin 52
threaded fastener 53
lead-in angle 54
spring washer 55
shell casing 56
case holder recess 58
first embodiment gripping shellplate 60
primer cam 61
primer cam assembly 62
primer cam base 64
slide back primer cam 66
dowel pin 68
primer cam 69
detent ball and spring 70
linear cam 72
cam track 74
index block sloping surface 76
index block vertical surface 78
primer indexing arm 80
first detent 82
second detent 83
detent ball 84
detent spring 85
detent ball pocket 86
detent ball retainer 88
case insert slide 89
case insert slide block 90
slide block root 92
case insert support rail 94
support rail groove 95 support rail channel 96
case slide tongue 97
case slide cam screw hole 98
smooth platform assembly 103
smooth casefeed assembly 106
smooth ring indexer 110
smooth cam leading edge 112
smooth cam trailing edge 114
second embodiment gripping shellplate 160

DETAILED DESCRIPTION

In describing the one or more representative embodiments of the inventive subject matter, use of directional terms such as "upper," "lower," "above," "below", "in front of" "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business-related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. Any embodiment described as "comprising" includes the case of "consisting only of." The scope of the inventive subject matter should not be limited by the particular embodiments herein described but should be defined only by the appended claims and equivalents thereof.

An inventive embodiment of a progressive shell reloader machine includes a smooth ring indexer 110, a roller cam actuator 30, a second embodiment gripping shellplate (60, 160) a antifriction camming pin 36, a primer cam assembly 62, and a case insert slide block 90.

Smooth Ring Indexer and Roller Cam Actuator

Figure 7:
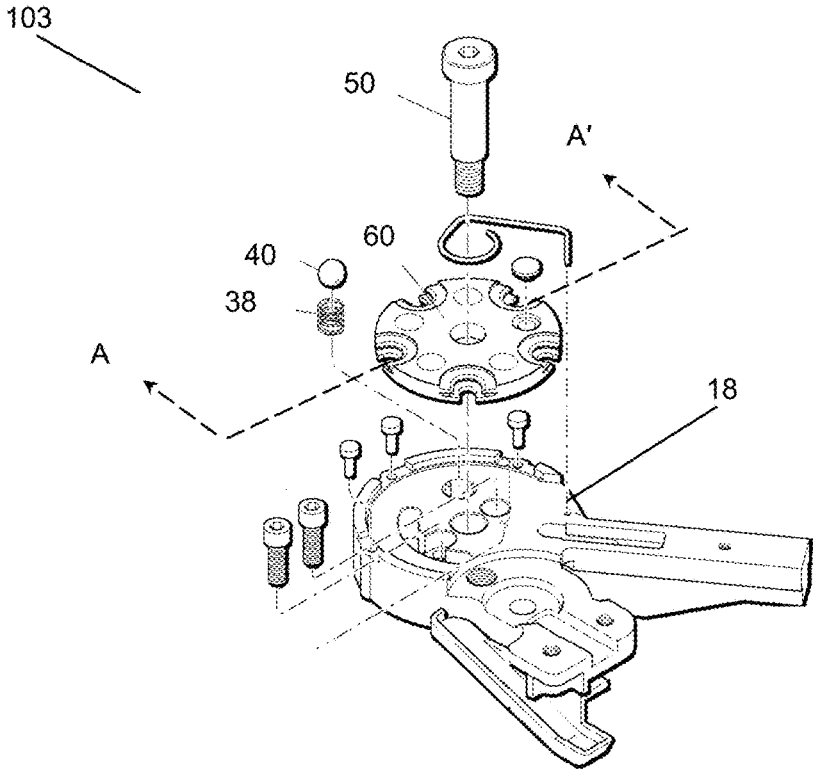
FIG. 7 is a view of a representative embodiment of an inventive platform assembly, showing a low inertia plastic indexing ball and spring.

FIG. 7 shows an embodiment of a smooth ring indexer 110 and a roller cam actuator 30. A smooth ring indexer 110 has a smooth acceleration cam 32 that applies a controlled acceleration to the shellplate 25. This is done by replacing the ring indexer 10 that has a linear cam 72 with the smooth ring indexer 110 that has a smooth acceleration cam 32. Also, the indexer block 24 is replaced with a roller cam actuator 30. Instead of having a camming surface which offers a single speed of rotation, the smooth acceleration cam 32 has a developed curve camming surface that follows an ogee curve. An ogee curve is a curve that is shaped somewhat like an S, consisting of two arcs that curve in opposite senses, so that the ends are parallel. The ogee curve shape causes the smooth ring indexer 110, when engaging the roller cam actuator 30, to begin the rotation of the shellplate 25 at a slow rate of acceleration, then gradually increase the rate of acceleration to the midpoint of the advancement, then decrease the rate of acceleration back to near zero at the end of the advancement. The ogee curve being such that when the smooth ring indexer 110 is pushed down onto the fixed roller cam actuator 30, the angle between a leading edge 112 of the smooth acceleration cam 32 and surface of the roller cam actuator 30 at the point of contact begins at close to parallel and parallel to the motion of the smooth ring indexer 110. As the smooth ring indexer 110 is pushed down further, the smooth acceleration cam 32 is pushed laterally by the roller cam actuator 30 with increasing acceleration, causing the smooth ring indexer 110 to rotate around the main shaft 28. The surface of the smooth acceleration cam 32 smoothly changes to an increasingly larger angle between the surfaces of the smooth acceleration cam 32 and the roller cam actuator 30 until the midpoint of the cam advance. Then from the midpoint of the cam advance, changes to a decreasingly smaller angle between the surfaces of the smooth acceleration cam 32 and the roller cam actuator 30, until at the end of the cam advance the angle returns to being parallel. This smoothly increasing and decreasing acceleration reduces shocks to the motion of the shellplate 25 and the powder filled shell casings 56 which could otherwise spill powder.

As the operating arm of the progressive reloading machine is moved upward, the main shaft 28 carries the ring indexer downward into contact with the roller cam actuator 30. As the contact angle between the surface of the roller cam actuator 30 and the surface of the smooth ring indexer 110 is near parallel, the smooth ring indexer 110 will begin moving slowly. As it does, the index pawl 16 is impelled upward by the pawl spring 14. The index pawl 16 will engage one of the holes in the shellplate 25 and begin rotating the shellplate 25. As the operating arm is moved further upward the contact angle between the surfaces of roller cam actuator 30 and the smooth ring indexer 110 increases, causing the smooth ring indexer 110 to advance at a faster rate. At the midpoint of the cam advance, the contact angle has increased to its maximum causing the smooth ring indexer 110 to attain its maximum rate of advancement. From the midpoint of the advance the contact angle of starts to decrease, slowing the rate of advance of the smooth ring indexer 110. At the end of the advance of the smooth ring indexer 110, the roller cam actuator 30 is again parallel with the cam surface of the smooth ring indexer 110 and the ring indexer has reached its maximum advancement. At this point the plastic indexing ball 40, impelled by the plastic ball index spring 38, locks the shellplate 25 to the platform 18. As the operating handle 9 is returned downward, the smooth ring indexer 110 is raised clear from contact with the roller cam actuator 30 and indexer return spring 12 rotates the smooth ring indexer 110 back to its starting position while the index pawl 16 rocks clear of the locating hole in the shellplate 25. The cycle is repeated each time the operating handle 9 is cycled.

Gripping Shellplate

Figure 8:
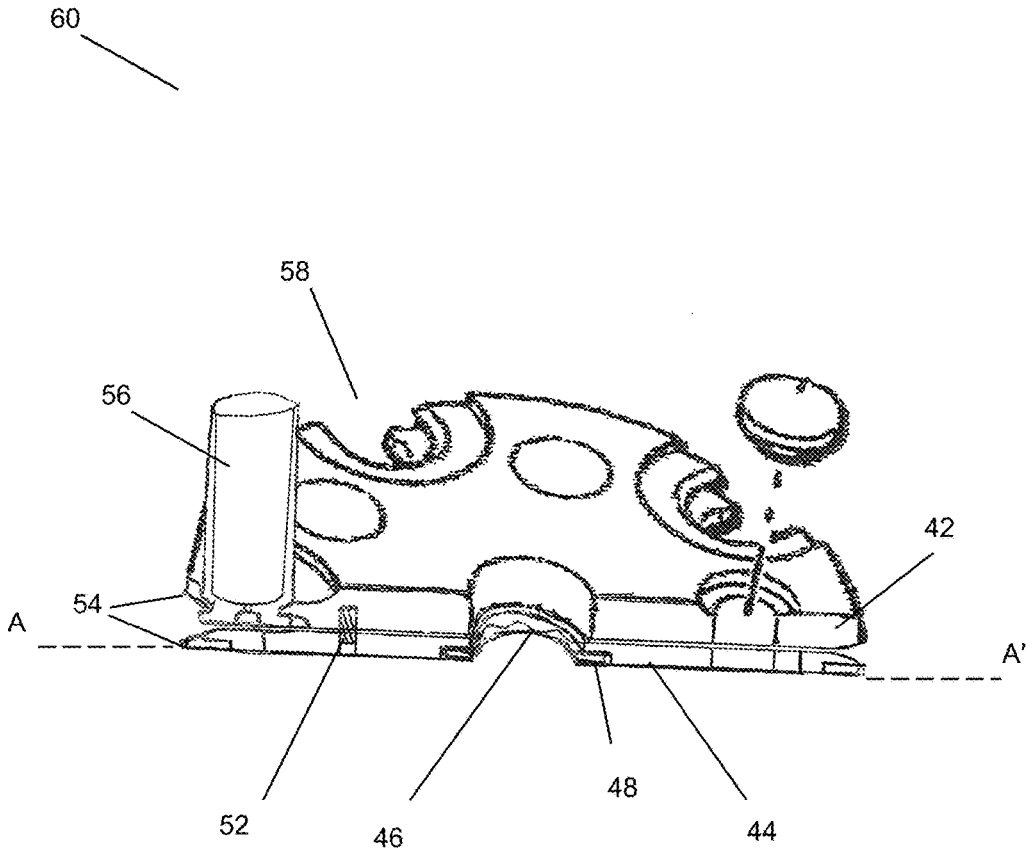
FIG. 8 is a sectional view of a first embodiment of a gripping shellplate.

FIG. 8 shows a cutaway figure (section A-A' in FIG. 7) of a first embodiment of a gripping shellplate 60. As with a one-piece shellplate 25, the shell casings 56 fit into case holder recesses 58 in the periphery of the shellplate. However, in the case of the gripping shellplate 60, the rim of the shell casings 56 extend slightly below the lower surface of the upper shellplate 42. The lower shellplate 44 is free from the upper shellplate 42 but has a dowel pin 52 press fit into recesses in the upper shellplate 42 and free fitting into the lower shellplate 44 to index the two shellplate parts together. In the lower center of the lower shellplate 44 is a cutaway portion which retains an elastic element 46, which may be a compression cone spring or a wave washer. The elastic element 46 should be light in force, only applying sufficient force to the gripping shellplate 60 to snug the shell casings 56 in the case holder recesses 58. Below the elastic element is provided a thrust washer 48. A second thrust washer 48 is placed on the shellplate bolt 50 above the gripping shellplate 60. The shellplate bolt 50 holds the gripping shellplate 60 together and applies pressure to the elastic element 46 which in turn urges the lower shellplate 44 upward against the rims of the shell casings 56 and the upper shellplate 42 downwards, holding the shell casings 56 snuggly and securely in their case holder recesses 58. The thrust washers 48 reduce friction between the platform 18, the shellplate bolt 50, and the gripping shellplate 60 during shellplate advancement.

Figure 9:
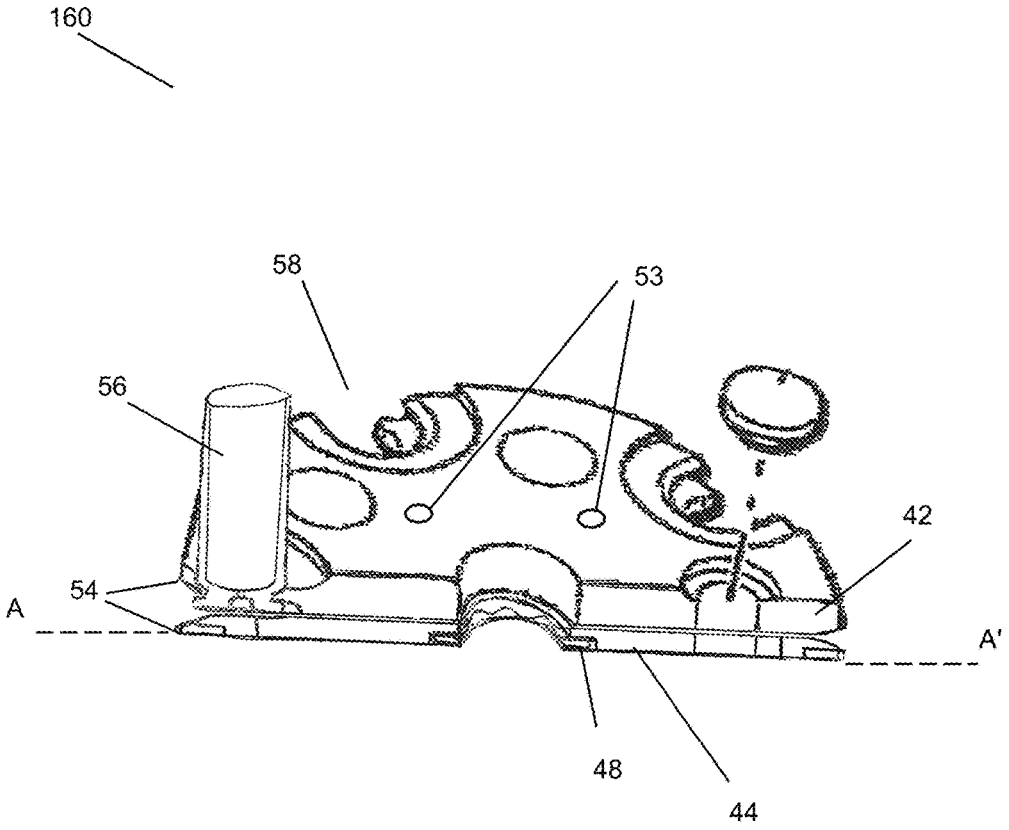
FIG. 9 is a sectional view of a second embodiment of a gripping shellplate.
Figure 10:
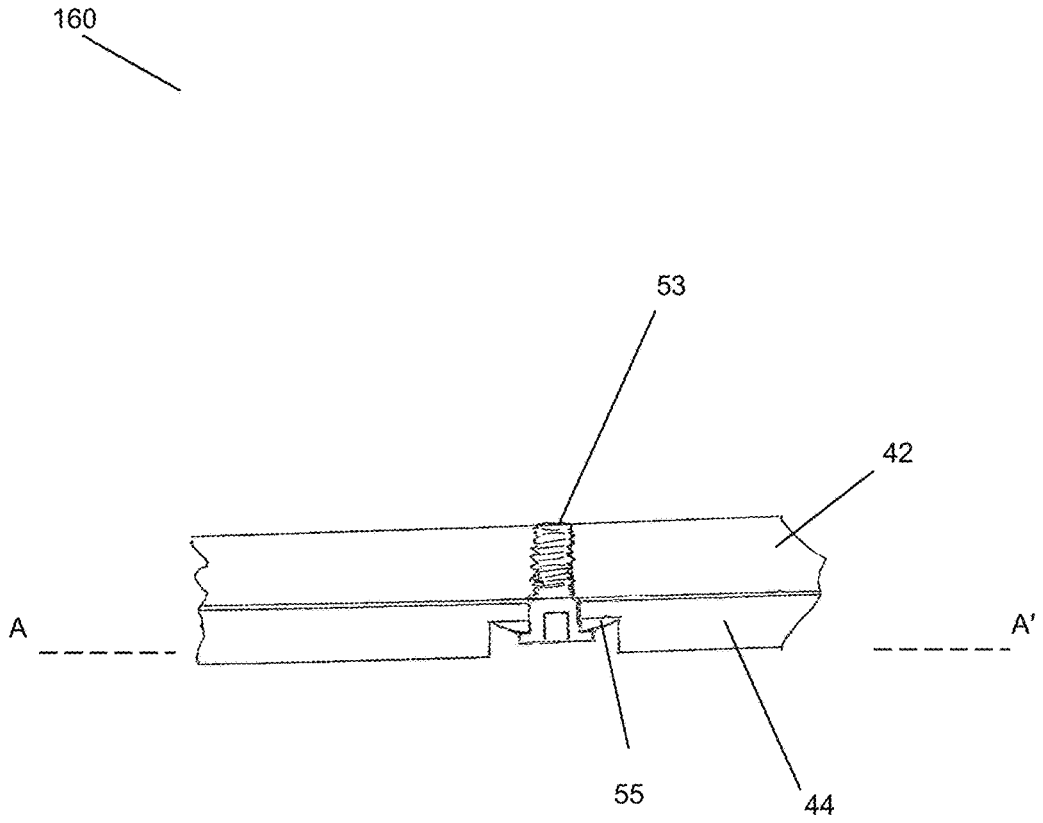
FIG. 10 is a detailed sectional view of the second embodiment of a gripping shellplate.
Figure 11:
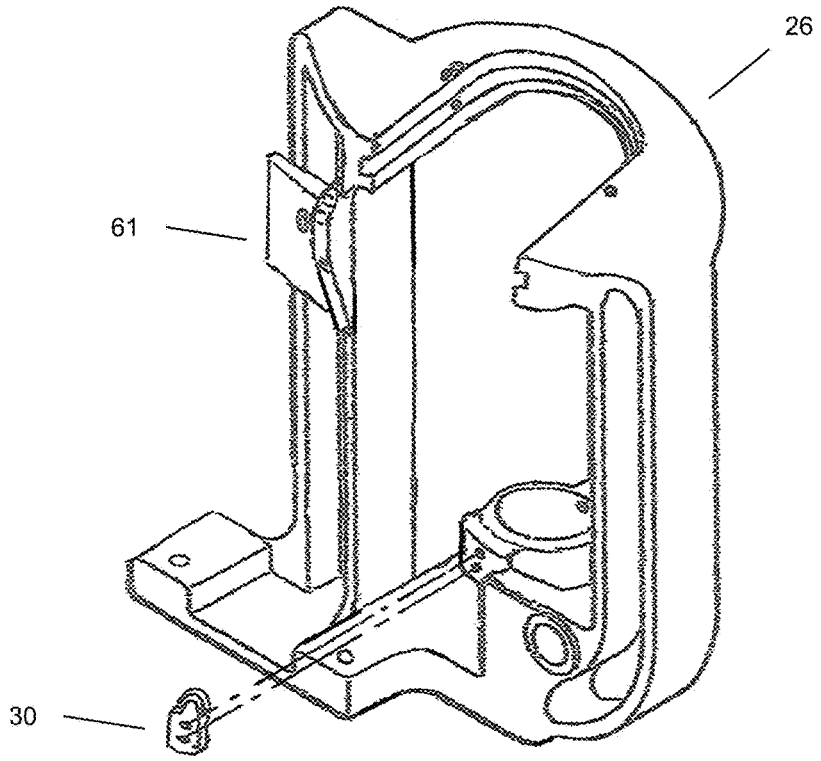
FIG. 11 (Prior Art)
FIG. 11 is a view of a prior art roller cam actuator fixed to the frame of the prior art progressive shell reloader machine.
Figure 12:
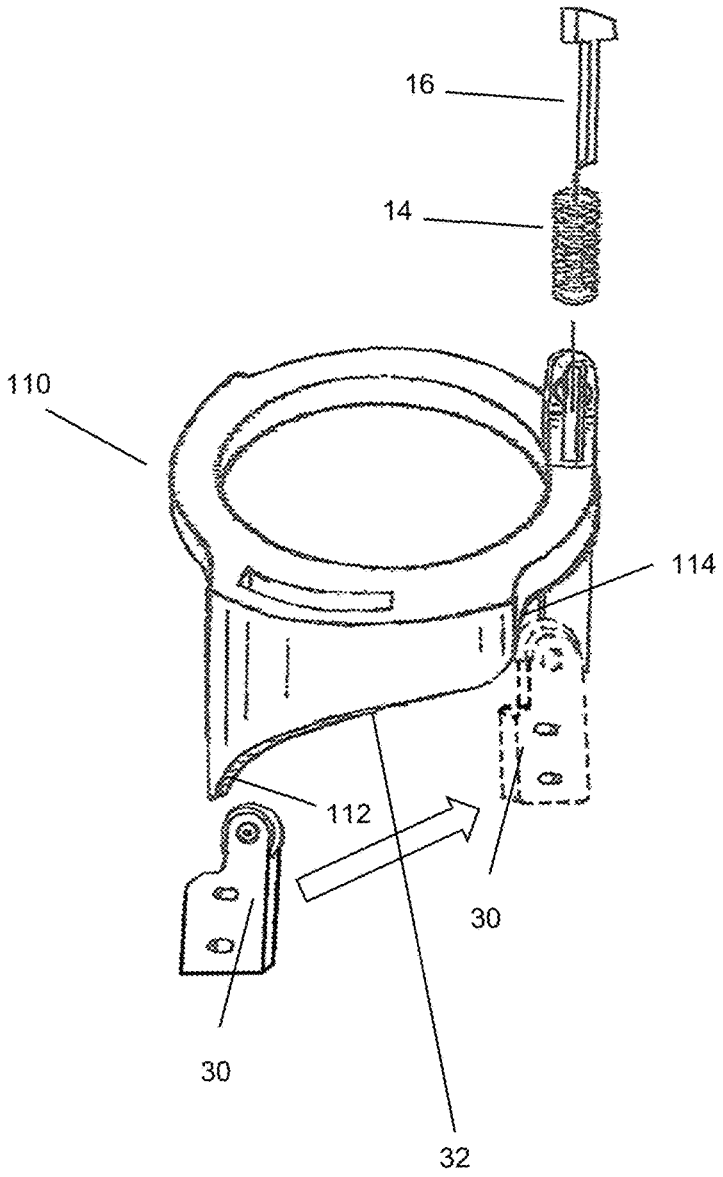
FIG. 12 is a view of an inventive smooth ring indexer and roller cam actuator.

FIG. 9 and FIG. 10 show a cutaway figure (section A-A' in FIG. 7) of a second embodiment of a gripping shellplate 160. The second embodiment of a gripping shellplate 160 is similar to the first embodiment of a gripping shellplate 60, but differs in that the recesses for the dowel pins 52 penetrate all the way through both the upper shellplate 42 and lower shellplate 44, and the dowel pins 52 are replaced by threaded fasteners 53. The threaded fasteners 53 are secured with spring washers 55. The threaded fasteners 53 apply pressure that pushes the lower shellplate 44 upward against the rims of the shell casings 56 and the upper shellplate 42 downward, holding the shell casings 56 snuggly and securely in their case holder recesses 58.

Antifriction Camming Pin

Figure 6:
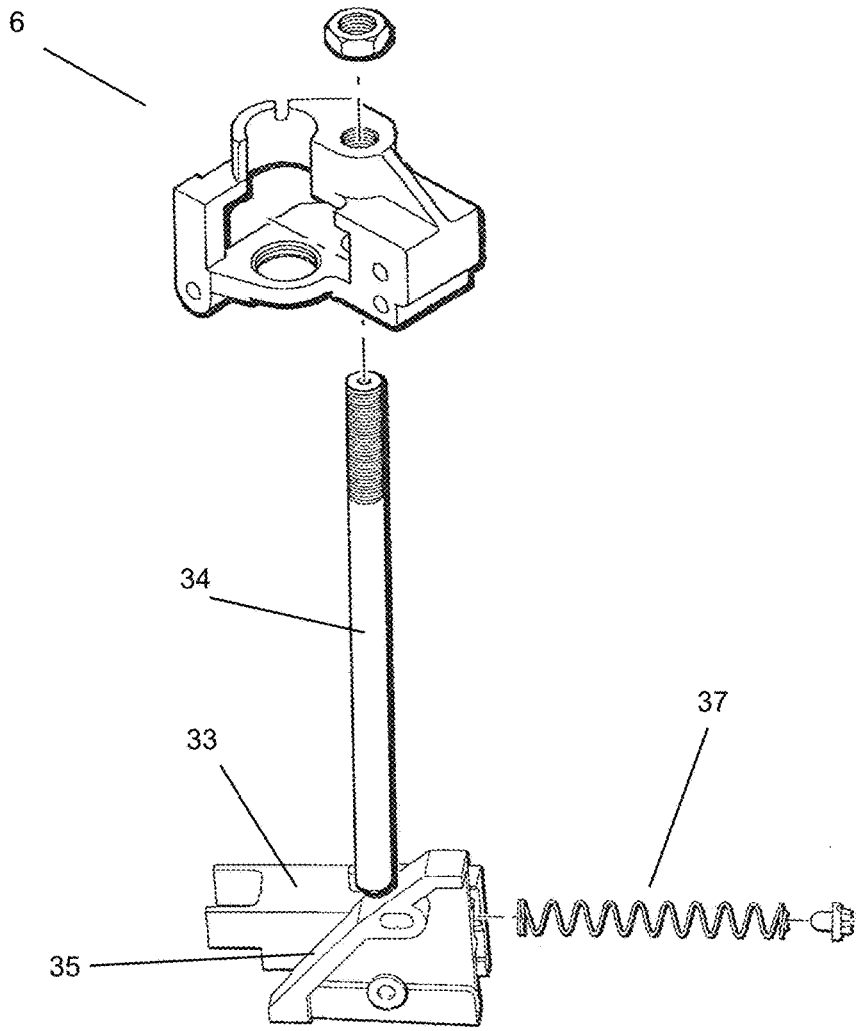
FIG. 6 (Prior Art)
FIG. 6 is a view of a casefeed assembly and a slide cam of the prior art progressive reloading machine.
Figure 13:
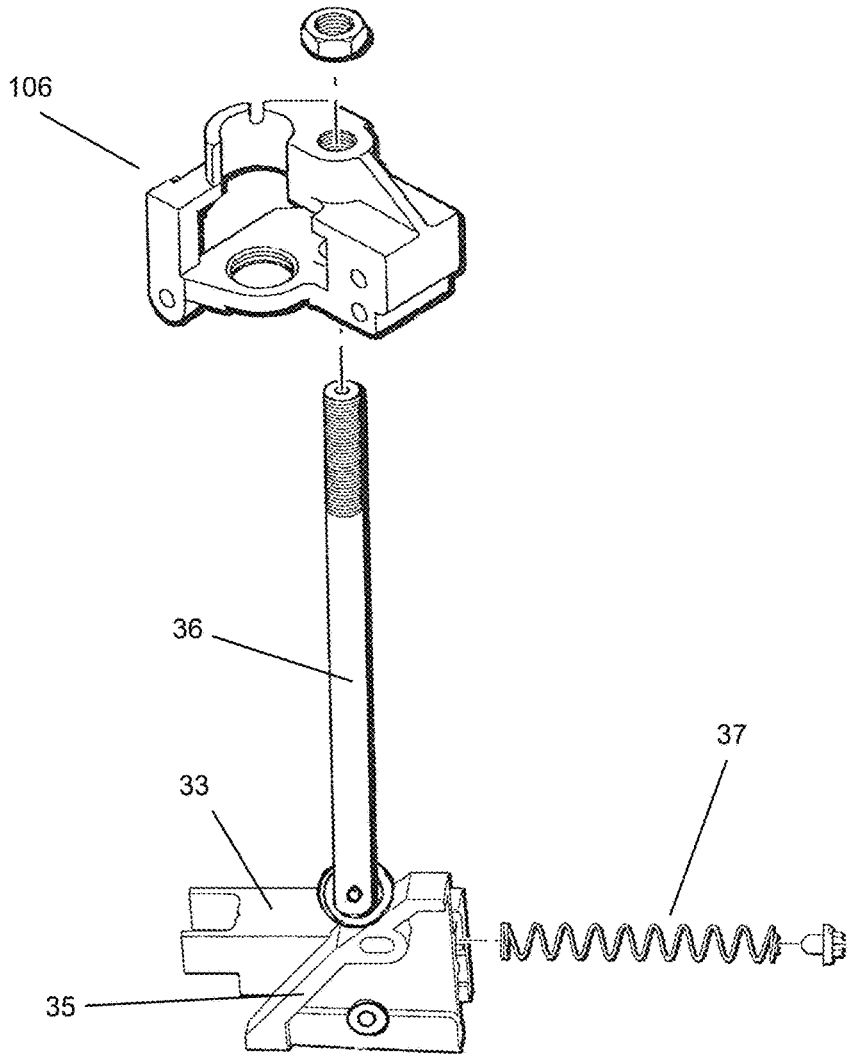
FIG. 13 is a view of a smooth casefeed assembly with an antifriction camming pin.

FIG. 13 shows a smooth casefeed assembly 106 with an antifriction camming pin 36. The antifriction camming pin 36 has an antifriction roller and replaces the camming pin 34 that has a blunt tip in the casefeed assembly 6 (see FIG. 6). The antifriction roller contacts the camming surface of the slide cam 35 and allows the use of a stronger case insert slide spring 37. It also provides smoother action of the case insert base 33 and reduces lubrication requirements and machine vibration The reloading process begins with one complete stroke or cycle of the reloading lever handle, which causes the first shell casing 56 to be cycled through the casefeed system and fed into the case holder recesses 58 of the first embodiment gripping shellplate 60 by case insert base 33, which is pushed by the case insert slide spring 37. The rim of the shell casing 56 will be forced between the upper shellplate 42 and lower shellplate 44 at the lead in angle 54 and will be held snuggly by entrapment between the lower shellplate 44 and the upper shellplate 42 the elastic element which may be either a wave washer or a thin cone spring applying a compressing force to the lower shellplate 44 and upper shellplate 42 which in turn supplies a snugging force onto the rims of the shell casings 56. As the upper shellplate 42 and lower shellplate 44 are urged together by the elastic element 46 they must be pried apart by the casefeed system as the shell casing 56 rim is forced between the upper shellplate 42 and lower shellplate 44. This may be facilitated by a case insert slide spring 37 stronger than the previous art, which the antifriction camming pin 36 to smoothly control the case insert slide and slide spring. As each cycle of the reloading lever handle is completed a new shell casing will be fed to one of the case holder recesses 58 and a completed cartridge will be ejected from the reloading machine. The operation of the second embodiment gripping shellplate 160 is similar.

Primer Cam Assembly

Figure 14:
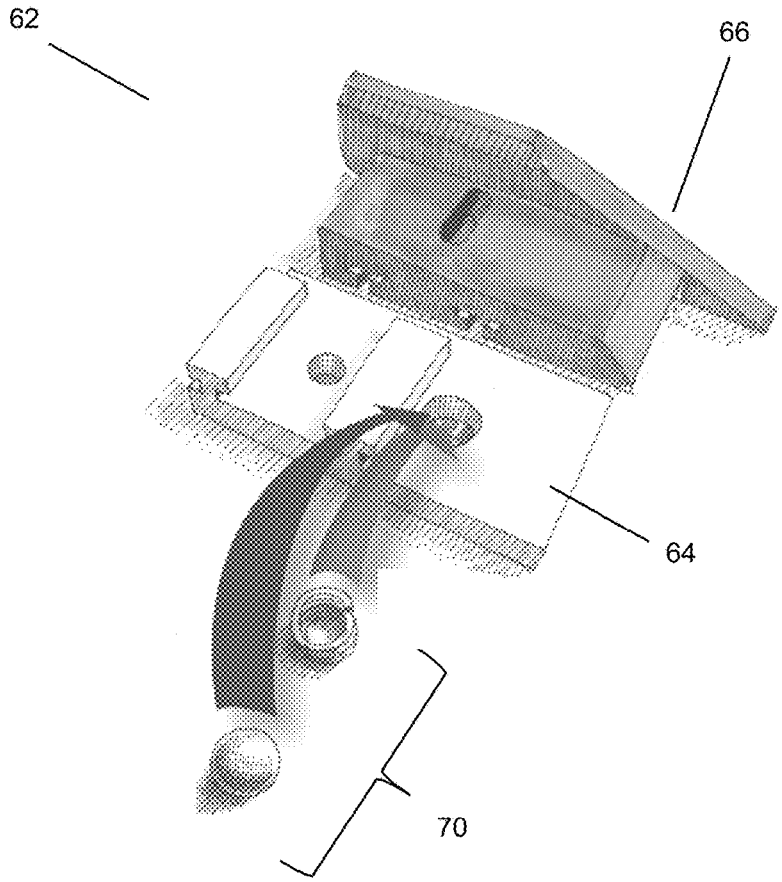
FIG. 14 is a view of an embodiment of a primer cam assembly with a slide back primer cam.
Figure 15B:
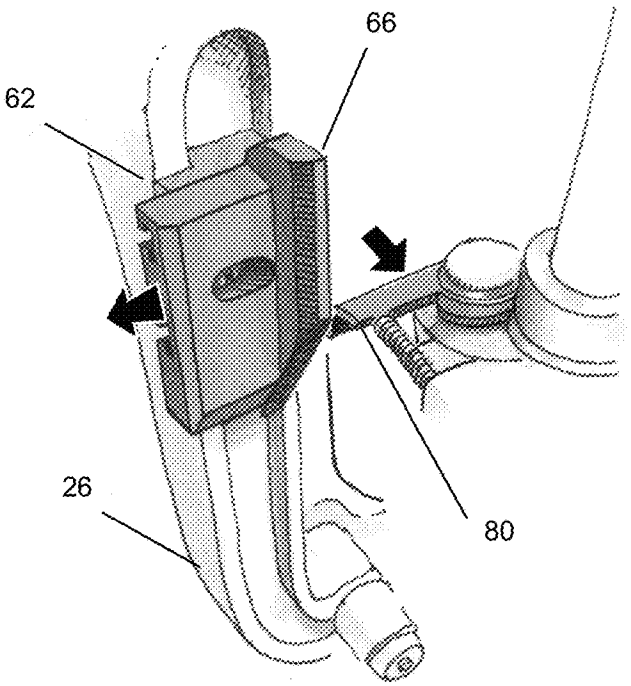
FIG. 15B is a view of the primer cam assembly with the slide back primer cam in an "off" position.
Figure 15A:
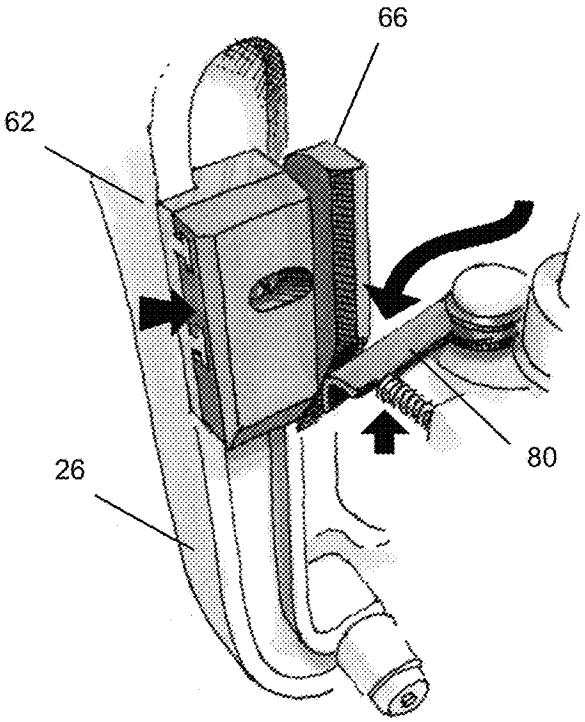
FIG. 15A is a view of the primer cam assembly with the slide back primer cam in an "on" position.

FIG. 14 Shows an embodiment of a primer cam assembly 62. The primer cam assembly 62 provides a mechanism to stop the automatic feeding of primers during adjustments of the reloading machine without the necessity of removing the primer feed assembly 7, which saves the operator time during those adjustments. The primer cam assembly 62 comprises a base 64 and a slide back primer cam 66. The base 64 is configured to be bolted to the frame 26 of the progressive shell reloader machine 1. The base 64 has two rails, parallel and spaced apart, providing sliding track for the slide back primer cam 66 to slide laterally. The slide back cam 66 has a pocket with a detent ball and spring 70 which are configured to engage with either of two detents in the slide back primer cam 66. The detent ball and spring 70 the slide back primer cam 66 in either a primer feed position or a primer stop position (see FIG. 15A and FIG. 15B).

The primer cam assembly 62 is used to stop the feeding of primers when it is desired to adjust the case operating dies and check their function without primers being automatically fed by the machine. The primer cam assembly 62 may be provided with red and green indicators to show whether the primer feed mechanism is operating or not engaged. When the slide back primer cam 66 is in the engaged position, a green surface is in the sight of the operator and primers will be fed. When the primer cam is not engaged, a red surface is in the sight of the machine operator and primers will not be fed.

Low Inertia Indexing Ball and Spring

FIG. 7 Shows a smooth platform assembly 103 of a high strength low inertia plastic indexing ball 40 and plastic ball index spring 38, having much lower inertia than prior art devices, which prevents bouncing of the shell casings. The prior art used a steel indexing ball 22 and a steel indexing spring 20. The steel indexing ball 22 with its strong steel indexing spring 20 impacted the shellplate 25 with enough force to cause gunpowder to be bounced from loaded cases. In the exemplary embodiment, he plastic ball index spring 38 and plastic indexing ball 40 are comprised of a high strength plastic such as polyamide-imide. The plastic indexing ball 40 together with the plastic ball index spring 38 reduces impact when the gripping shellplate 60 advances to the next position, reducing the loss of gunpowder from shell casings 56.

Case Insert Slide Block

Figure 16:
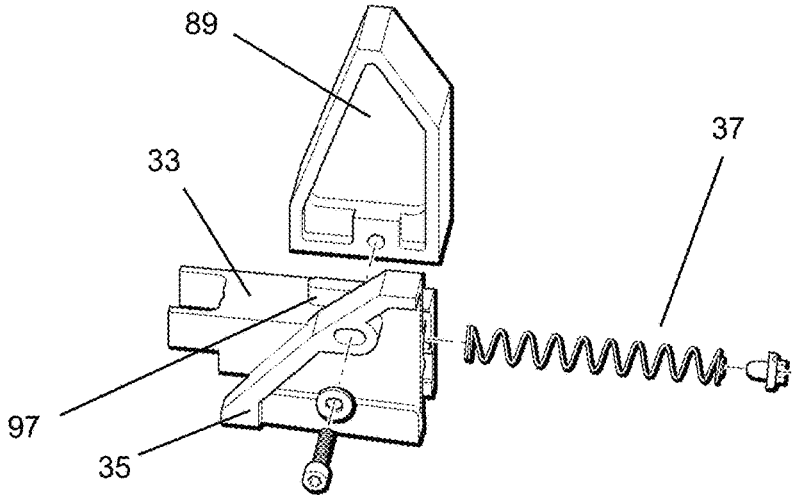
FIG. 16 (Prior Art)
FIG. 16 shows a prior art case insert slide.
Figure 17:
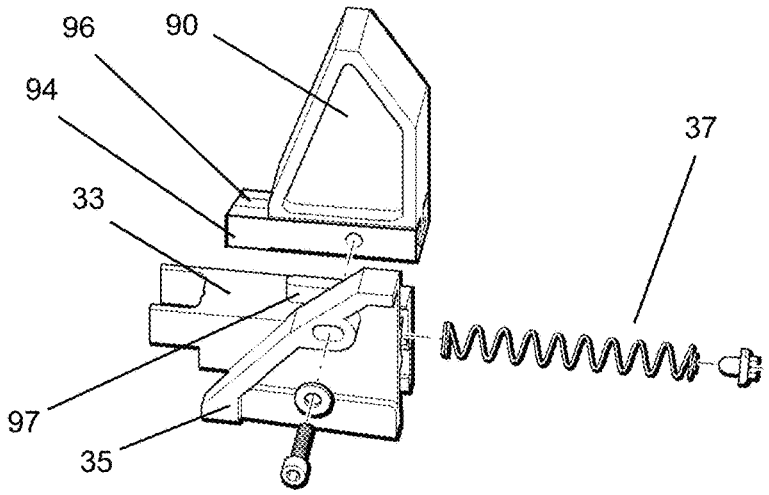
FIG. 17 show an embodiment of an inventive case insert slide comprising a case insert slide block and a case insert support rail.

FIG. 16 shows a prior art case insert slide 89. The case insert slide 89 nests on a tongue 97 of the case insert base 33 is held in place with a screw through the slide cam 35. The case insert slide 89 can be oriented one way for rifle shell casings 56, with the shorter slope facing the shellplate (not shown, but opposite from the case insert slide spring 37) or oriented a second way for pistol shell casings 56, with the longer slope facing toward the shellplate. However, changing orientations requires removal of the screw through the slide cam 35.

FIGS. 17-22 show an embodiment of an inventive case insert slide comprising a case insert slide block 90 and a case insert support rail 94. The case insert support rail 94 has a lipped channel 96 cut into its topside and a groove 95 cut into its underside. The groove 95 is configured to slidingly fit over the tongue of the case insert base 33. The case insert slide block 90 has a root 92 (See FIG. 22) that is configured to slidingly fit in the support rail channel 96. The case insert support rail 94 has a first detent 82 and a second detent 83 in the bottom of the support rail channel 96. The case insert slide block 90 has detent ball pocket 86 with a detent ball 84 and a detent spring 85 positioned inside. The case insert slide block 90 is configured to slide back and forth in the support rail channel 96. When the detent ball 84 is positioned over one of the detents, the detent ball 84 is pushed into the detent by the detent spring 85. The detents 82, 83, the detent spring 85, and the detent ball 84 are configured so that the case insert slide block 90 will tend to remain in that position, regardless of vibration and jostling, but a larger force applied by a human hand can pull the detent ball 84 out of the detent that it is in and reposition the case insert slide block 90. The detent ball 84 is held in the detent ball pocket 86 by a detent ball retainer 88, so that the detent ball 84 will not fall out if the case insert slide block 90 is completely removed from the support rail channel 96. In the exemplary embodiment, the detent ball retainer 88 is a snap ring, but in other embodiments, may be different type of retainer, such as a threaded ring retainer.

Figure 18:
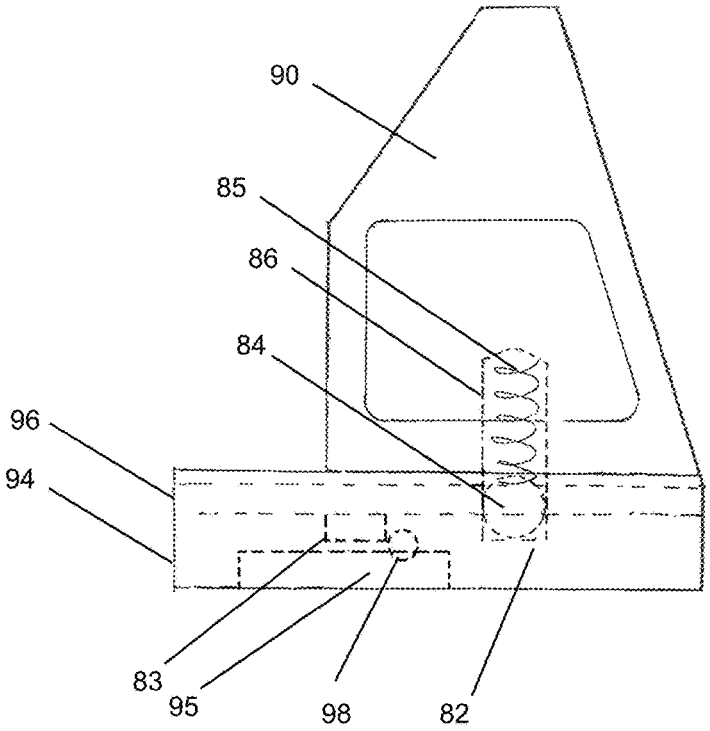
FIG. 18 shows the case insert slide block in a first position configured for rifle shell casings.

FIG. 18 shows the case insert slide block 90 in a first position configured for rifle shell casings 56 with the short slope facing left, towards the shellplate (25, 60, 160, not shown in FIG. 18). In the first position, the detent ball 84 is in the first detent 82. This position facilitates running the progressive shell reloader machine 1 without loading shell casings 56 into the shellplate with every pull of the operating handle 9, because the case insert slide block 90 is not in position to contact an arm on the casefeed assembly 6 that releases a shell casing 56. This position is useful for troubleshooting the progressive shell reloader machine 1.

Figure 19:
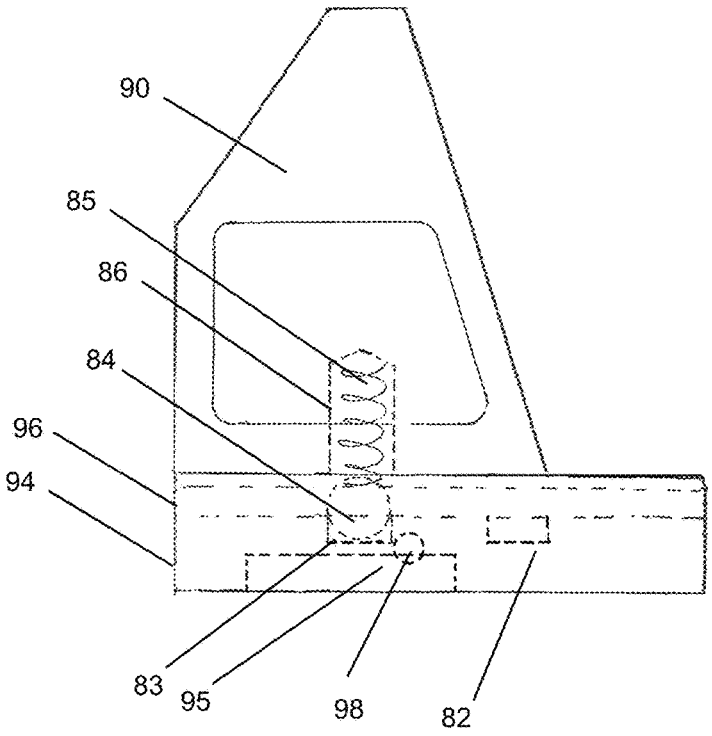
FIG. 19 shows the case insert slide block in a second position configured for rifle shell casings.

FIG. 19 shows the case insert slide block 90 in a second position configured for rifle shell casings 56 with the short slope facing left, towards the shellplate (25, 60, 160, not shown in FIG. 18). This position allows the progressive shell reloader machine 1 to run normally, with the case insert slide block 90 contacting the arm on the casefeed assembly 6 when the operating handle 9 is pulled and the platform 18 is lifted, releasing a shell casing 56 that is pushed by the case insert base 33 into the shellplate.

Figure 20:
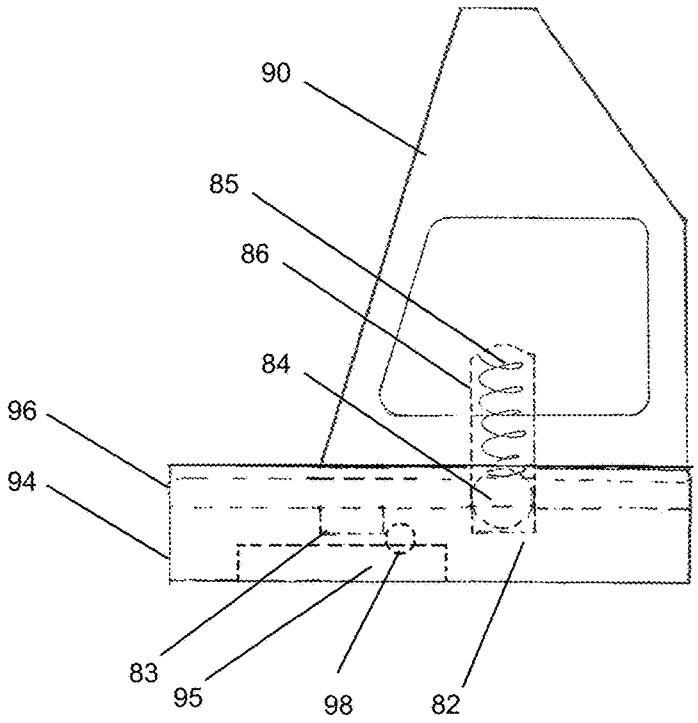
FIG. 20 shows the case insert slide block in a first position configured for pistol shell casings.

FIG. 20 shows the case insert slide block 90 in a first position configured for pistol shell casings 56 with the long slope facing left, towards the shellplate (25, 60, 160, not shown in FIG. 18). This position allows the progressive shell reloader machine 1 to run without loading a shell casing 56 into the shellplate with every pull of the operating handle 9.

Figure 21:
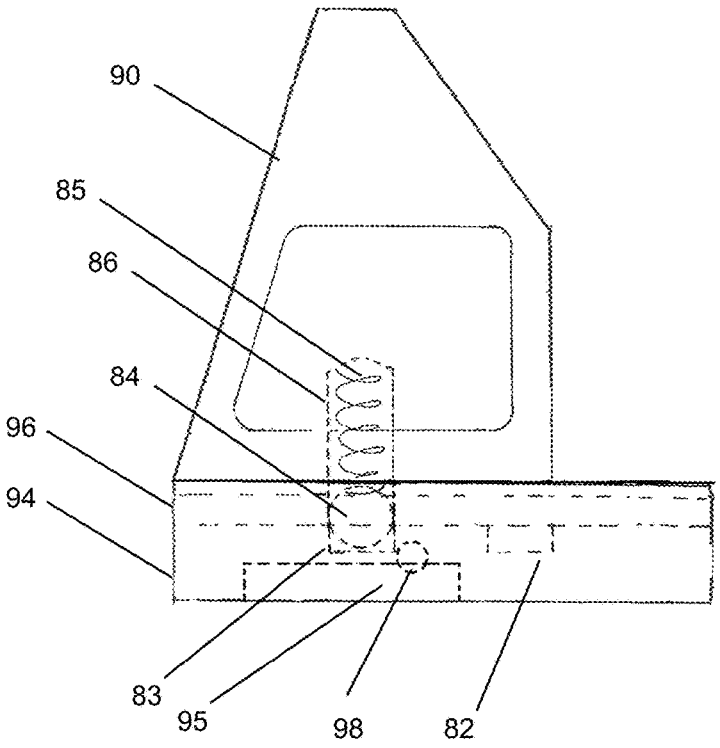
FIG. 21 shows the case insert slide block in a second position configured for pistol shell casings.

FIG. 21 shows the case insert slide block 90 in a second position configured for pistol shell casings 56 with the long slope facing left, towards the shellplate (25, 60, 160, not shown in FIG. 18). This position allows the progressive shell reloader machine 1 to run normally, loading a shell casing 56 into the shellplate with every pull of the operating handle 9.

Figure 22:
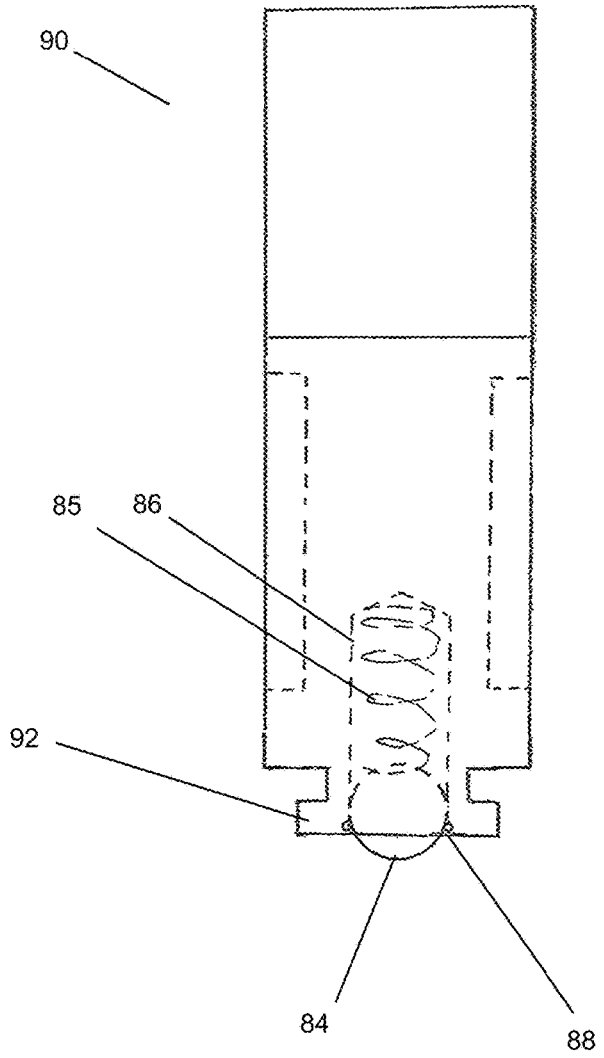
FIG. 22 shows a sectional view of the case insert slide block, showing the slide block root and the detent ball pocket.

FIG. 22 shows a sectional view of the case insert slide block 90, showing the slide block root 92 and the detent ball pocket 86.

What is claimed is:

1. A cartridge case reloader comprising:

a frame, a plurality of reloading tools coupled to the frame at angularly spaced apart stations;

a main shaft slidingly coupled to the frame through a hole in the frame, the main shaft configured for moving alternately upwardly toward the reloading tools and downwardly away from the reloading tools;

a platform assembly coupled to the main shaft, the platform assembly having a platform and a gripper shellplate nested within the platform, the platform configured rotationally indexing the gripper shellplate in angular steps;

a casefeed assembly coupled to the frame;

a primer feed assembly coupled to the platform assembly;

a roller cam actuator coupled to the frame;

wherein the platform assembly includes a smooth ring indexer with a smooth acceleration cam with a camming surface that follows an ogee curve, the smooth ring indexer coupled to the main shaft under the platform, the smooth acceleration cam configured to engage the roller cam actuator when the platform assembly moves downward; and wherein the platform assembly includes an index pawl and a pawl spring configured to transmit rotational motion from the smooth ring indexer to the gripping shellplate.

2. The cartridge case reloader of claim 1, wherein the roller cam actuator has a ball bearing configured to make contact with the camming surface of the smooth ring indexer.

3. A cartridge case reloader comprising:

a frame, a plurality of reloading tools coupled to the frame at angularly spaced apart stations;

a main shaft slidingly coupled to the frame through a hole in the frame, the main shaft configured for moving alternately upwardly toward the reloading tools and downwardly away from the reloading tools;

a platform assembly coupled to the main shaft, the platform assembly having a platform and a gripper shellplate nested within the platform, the platform configured rotationally indexing the gripper shellplate in angular steps;

a casefeed assembly coupled to the frame;

a primer feed assembly coupled to the platform assembly; and the gripper shellplate has a lower shellplate and an upper shellplate coupled by an elastic element.

4. A cartridge case reloader comprising:

a frame, a plurality of reloading tools coupled to the frame at angularly spaced apart stations;

a main shaft slidingly coupled to the frame through a hole in the frame, the main shaft configured for moving alternately upwardly toward the reloading tools and downwardly away from the reloading tools;

a platform assembly coupled to the main shaft, the platform assembly having a platform and a gripper shellplate nested within the platform, the platform configured rotationally indexing the gripper shellplate in angular steps;

a casefeed assembly coupled to the frame;

a primer feed assembly coupled to the platform assembly; and the gripping shellplate has a lower shellplate and an upper shellplate coupled by a plurality of threaded fasteners and spring washers.

5. A cartridge case reloader comprising:

a frame, a plurality of reloading tools coupled to the frame at angularly spaced apart stations;

a main shaft slidingly coupled to the frame through a hole in the frame, the main shaft configured for moving alternately upwardly toward the reloading tools and downwardly away from the reloading tools;

a platform assembly coupled to the main shaft, the platform assembly having a platform and a gripper shellplate nested within the platform, the platform configured rotationally indexing the gripper shellplate in angular steps;

a casefeed assembly coupled to the frame;

a primer feed assembly coupled to the platform assembly; and wherein the casefeed assembly has antifriction camming pin provided with a roller configured for contact with a slide cam.

6. A cartridge case reloader comprising:

a frame, a plurality of reloading tools coupled to the frame at angularly spaced apart stations;

a main shaft slidingly coupled to the frame through a hole in the frame, the main shaft configured for moving alternately upwardly toward the reloading tools and downwardly away from the reloading tools;

a platform assembly coupled to the main shaft, the platform assembly having a platform and a gripper shellplate nested within the platform, the platform configured rotationally indexing the gripper shellplate in angular steps;

a casefeed assembly coupled to the frame;

a primer feed assembly coupled to the platform assembly;

a primer cam assembly with a primer cam base and a slide back primer cam;

wherein the primer cam base is coupled to the frame;

wherein the primer cam base has two parallel rails and a plurality of detents;

wherein the slide back primer cam has two grooves that sliding fit over the two parallel rails; and wherein the slide back primer cam has a pocket with a detent ball and spring configured to engage with plurality of detents in the slide back primer cam.

* * * * *